United States Patent [19]

Agren et al.

[11] Patent Number: 4,747,206

[45] Date of Patent: May 31, 1988

[54] METHOD OF PRODUCING ELECTRICAL COIL UNITS, PARTICULARLY FOR IGNITION APPARATUS

[75] Inventors: Nils A. Ågren; Rolf L. Rask; Lars-Olof Ottosson, all of Åmål, Sweden

[73] Assignee: Aktiebolaget Svenska Elektromagneter, Åmål, Sweden

[21] Appl. No.: 882,092

[22] Filed: Jul. 3, 1986

[30] Foreign Application Priority Data

Jul. 4, 1985 [SE] Sweden ..... 8503343

[51] Int. Cl.[4] ..... H01F 7/06

[52] U.S. Cl. ..... 29/605; 242/7.03; 242/7.09; 336/182

[58] Field of Search ..... 29/605, 606; 242/7.03, 242/7.07, 7.09; 336/180, 182

[56] References Cited

U.S. PATENT DOCUMENTS 4,023,262 5/1977 Miknaitis ..... 29/605

4,473,811 9/1984 Schauble ..... 29/605 X

*Primary Examiner*—Carl E. Hall

*Attorney, Agent, or Firm*—Hill, Van Santen, Steadman & Simpson

[57] ABSTRACT

A method of winding coils in one and the same wire size, so that they can be tailored to prevailing circuit requirements, includes, for example, when a lower resistance is required, a partial winding is first wound in one direction from a first connection to a second connection, the wire then being wound from the second connection in the opposite direction for joining to the first connection.

3 Claims, 1 Drawing Sheet

METHOD OF PRODUCING ELECTRICAL COIL UNITS, PARTICULARLY FOR IGNITION APPARATUS

BACKGROUND OF THE INVENTION

1. Field of the Invention

A method of producing electrical coil units, particularly for ignition apparatus.

2. Prior Art

In certain embodiments of capacitive ignition systems used in conjunction with ignition apparatus of the flywheel type, the ignition transformer and charging coil are placed on one and the same leg of an iron core. A typical example of such embodiment is described in U.S. Pat. No. 4,036,201. Apart from the windings mentioned there, there is often also a control winding or trigger winding on the same core leg. With such an arrangement, there is consequently obtained a coil unit for mounting directly onto the core leg in question.

In usual cases, the secondary winding of the ignition transformer is wound with one wire size on a coil bobbin or as a self supporting unit, and the charging coil is wound with a fairly similar wire size on another coil bobbin or as a further self supporting unit. From the production-winding aspect, it is extremely impractical to work with several wire sizes. Modern wire winding machines can indeed be controlled for both automatic connection to terminal pins and winding wire on a bobbin, but if several different wire sizes are to be wound on one and the same bobbin, it will be necessary either to put the bobbin into another winding machine with other wire sizes or to change the wire stock coil. These practices result in cost-consuming downtime, particularly in connection with large manufacturing orders.

SUMMARY OF THE INVENTION

The present invention is directed to a solution of the problem in question. By mutually adjusting the secondary winding and charging coil dimensions and the number of turns, the use is enabled, in accordance with the invention, of a single wire size for two or more types of coil or winding section. For example, the charging coil may comprise a winding composed of two or more functionally parallel-connected windings. According to a special feature of the invention, a partial winding is wound in the opposite direction for connection to the starting end of the first partial winding, the take-off points of the partial windings being used as connections for current circuits involved. There is consequently obtained a coil comprising two partial windings, which thus withstands a greater current throughput. In this way, several different types of winding can be achieved in a single set-up in an automatic winding machine while utilizing a single wire size. Considerable increase of efficiency in manufacture is thus achieved.

Many other advantages and features of the present invention will become manifest to those versed in the art upon making reference to the detailed description and the accompanying sheet of drawings in which a preferred structural embodiment incorporating the principles of the present invention is shown by way of illustrative example.

ON THE DRAWING

Figure 3:
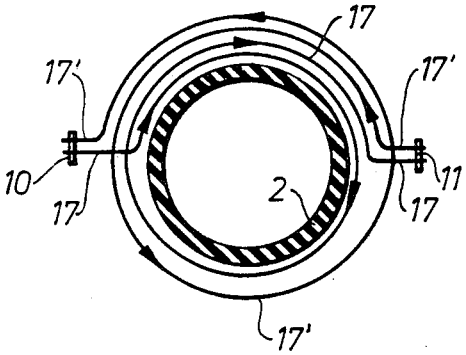

FIG. 3 schematically illustrates the arrangement of partial windings.

AS SHOWN ON THE DRAWINGS

Figure 1:
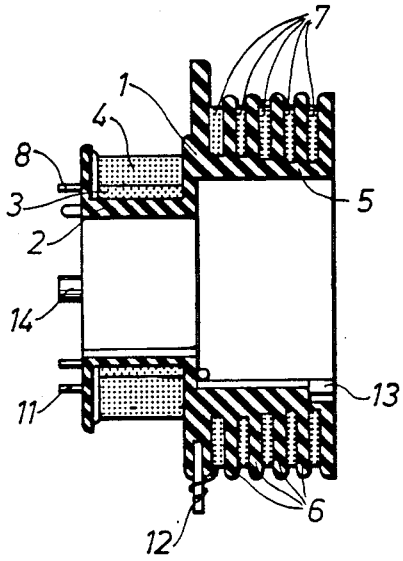
FIG. 1 is a cross section of a coil bobbin with windings.

The apparatus illustrated in FIG. 1 comprises a coil bobbin 1 made in two sections, a first section 2 carrying windings 3 and 4, here intended for triggering and charging, respectively. On a laterally situated second section 5 of the bobbin 1, there is provided a secondary winding 7 in sections or grooves 6 for the ignition transformer. The secondary winding 7 is intended to coact with a primary winding, which is arranged in the section 5 but is not shown in this view, since it is not part of the invention.

Figure 2:
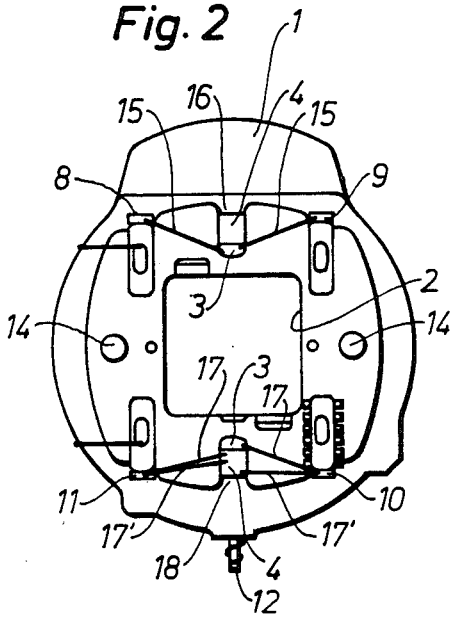
FIG. 2 is a view of the same coil bobbin from one end.

Four terminal pins 8, 9, 10, 11 (FIG. 2) are arranged on the end surface of the first bobbin section 2. In the intermediate portion between the first section 2 and the second section 5 of the bobbin 1 there is a terminal pin 12 arranged for the winding 7, the other end of the winding being attached to a pin 13 (FIG. 1). The bobbin is provided with locating pins 14 for fitting to a circuit board, for example.

Manufacture of a coil unit takes place in the following manner. The winding machine which is to be used is set up for attaching a wire end 15 at the terminal pin 8. The wire is then conventionally passed in through a first slit 16 in the end wall and winding is commenced. When the required number of turns has been reached, i.e. when the winding 3 has been completed, the wire 15 is taken out for fastening to the pin 9. The machine is then set up to carry out a connection of the wire now denoted 17, and of the same size as before, to the terminal pin 10. The wire is now passed conventionally in through the second end wall slit 18 and winding is commenced. When the required number of turns has been reached, the wire 17 is taken to the terminal pin 11 and attached to it. The wire is not cut here, however, but is wound once again as a wire part 17′, more wire now being wound on in the opposite winding direction to the winding formed by the wire 17. When a corresponding number of turns has been reached, the end of the wire 17′ is taken out to be fastened to the terminal pin 10. In this way, two partial windings have been achieved, which are functionally parallel-connected by the connection procedure shown. This winding 4, which in this product is to be used as a charging winding, must be able to withstand higher current strength than the previous triggering winding 3. Thus, the charging winding 4 comprises two partial windings connected in parallel.

FIG. 3 shows schematically how the winding part 17 from the pin 10 is wound in the direction indicated by the arrows, and up to the pin 11. Here the wire is attached and returned now for winding as part 17′ in the opposite direction, as shown by the arrows, and when the equivalent number of turns has been reached, it is taken out for connection to the terminal pin 10. Thus, both the coils are electrically connected in parallel.

Within the scope of the invention, such embodiments may, of course, be envisaged where several partial windings are made, which may be connected in parallel for achieving lower internal resistance, i.e., such as to enable them to carry higher currents and for adapting to associated circuits. Partial windings may, of course, be made as well, these being wound in the same direction and functionally connected in parallel for meeting necessary requirements. As will be seen, a very efficient technique has been provided with the aid of the invention for producing coil units, and with a suitable selection of wire sizes and positional adjustment of the different windings in relation to each other, all the winding types present in a coil unit may in certain embodiments be wound with one and the same wire size.

Thus, the invention relates to a method of winding coil units, particularly for ignition apparatus of the flywheel type. The invention provides a method of producing coil units which decreases the down-time in production required to change wire sizes.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A method for producing ignition transformers for an ignition apparatus, comprising the steps of:

attaching a first wire end of a first wire to a first terminal pin;

winding said first wire on a first bobbin section to form a first winding;

attaching a second end of said first wire to a second terminal pin;

attaching a first wire end of a second wire to a third terminal pin;

winding said second wire on said first bobbin section over said first winding to form a first partial winding;

attaching said second wire to a fourth terminal pin;

winding said second wire on said first bobbin section in an opposite winding direction as said over the first winding to form a second partial winding; and attaching said second wire to said third terminal pin so that first and second partial windings are in parallel and wound in opposite direction and together form a second winding.

2. A method according to claim 1, in which the number of turns wound to form said first partial winding in said one direction is the same as the number of turns wound to form said second partial winding in said opposite direction.

3. A method according to claim 1, in which the second coil winding is made by winding further partial windings, and connecting them together in electrical parallel.

* * * * *